US008009126B2

(12) United States Patent
Satou et al.

(10) Patent No.: US 8,009,126 B2
(45) Date of Patent: Aug. 30, 2011

(54) CURRENT DRIVE CIRCUIT AND DISPLAY DEVICE

(75) Inventors: Kenji Satou, Miyazaki (JP); Yoshihiro Nakatake, Miyazaki (JP)

(73) Assignee: Oki Semiconductor Co., Ltd. (JP)

( * ) Notice: Subject to any disclaimer, the term of this patent is extended or adjusted under 35 U.S.C. 154(b) by 957 days.

(21) Appl. No.: 11/940,478

(22) Filed: Nov. 15, 2007

(65) Prior Publication Data

US 2008/0117145 A1 May 22, 2008

(30) Foreign Application Priority Data

Nov. 22, 2006 (JP) ..... 2006-315282

(51) Int. Cl.
*G09G 3/30* (2006.01)

(52) U.S. Cl. ..... 345/76; 345/77

(58) Field of Classification Search ..... 345/76–84, 345/87, 204; 315/169.1, 169.3
See application file for complete search history.

(56) References Cited

U.S. PATENT DOCUMENTS

2005/0174307 A1* 8/2005 Nishitoba et al. ..... 345/76
2007/0040773 A1* 2/2007 Lee et al. ..... 345/77

FOREIGN PATENT DOCUMENTS

JP 2003-288051 A 10/2003

* cited by examiner

*Primary Examiner* — Regina Liang
(74) *Attorney, Agent, or Firm* — Studebaker & Brackett PC; Donald R. Studebaker

(57) ABSTRACT

In a current drive circuit, variation in output current is reduced. A current adjustment section and a current output section generate a grayscale according to a target grayscale. The current adjustment section generates an intermediate current Iint, which is a reference current Iref multiplied by a first coefficient, and the current output section generates an output current Iout, which is the intermediate current Iint multiplied by a second coefficient. The minimum value of the first coefficient is set in advance such that when the first coefficient is at a minimum value the voltage at a node (for the minimum grayscale) is greater than or equal to a predetermined first value which is larger than the operation threshold voltage of PMOS transistors in the current output section.

4 Claims, 6 Drawing Sheets

FIG. 2

| SEL0 | SEL1 | Iint/Iref |
|---|---|---|
| H | H | 13 |
| L | H | 14 |
| H | L | 15 |
| L | L | 16 |

FIG. 3

| SEL2 | SEL3 | d42 | d43 | d44 | Iout/Iint |
|---|---|---|---|---|---|
| L | L | L | L | L | 16 |
| H | L | H | L | L | 32 |
| L | H | L | L | H | 48 |
| H | H | H | H | H | 64 |

100

50

CURRENT DRIVE CIRCUIT AND DISPLAY DEVICE

CROSS-REFERENCE TO RELATED APPLICATION

This application claims priority under 35 USC 119 from Japanese Patent Application No. 2006-315282, the disclosure of which is incorporated by reference herein.

BACKGROUND OF THE INVENTION

1. Field of the Invention

The present invention relates to current drive technology for a display panel having current-driven light emitting elements, such as organic EL (electroluminescence), arranged in a matrix.

2. Description of the Related Art

There is known a display device that includes a display panel having organic EL elements as self-luminous elements arranged in a matrix and drives the organic EL elements using electric current. A display device using organic EL elements is characterized by low power consumption, no illumination part, such as a backlight, and a very fast display response speed, and hence regarded as a promising future display device.

In the display device described above, a current drive circuit on the anode side of the organic EL elements (anode driver) generates a grayscale drive current according to display brightness based on a constant current. For example, the current drive circuit disclosed in Japanese Patent Application Laid-open (JP-A) No. 2003-288051 includes a current mirror circuit and uses the mirror ratio of the current mirror circuit to generate multi-grayscale drive currents.

The conventional current drive circuit includes a grayscale generation circuit (corresponding to the "D/A conversion circuit" in JP-A No. 2003-288051) that generates a current (grayscale current) according to the grayscale and an output circuit that amplifies and outputs the grayscale current. However, a smaller grayscale current results in a smaller gate-source voltage $V_{GS}$ in the MOSFET that is a component of the current mirror circuit in the first stage of the output circuit. Therefore, when the conventional grayscale generation circuit is used, variation in operation threshold voltage of the MOSFET likely affects the current from the output circuit (current to be supplied to an organic EL element). There has thus been a desire for a current drive circuit and a display device with smaller variation in output current and hence smaller variation in brightness of display elements.

SUMMARY OF THE INVENTION

The present invention has been made in view of the above circumstances and provides a drive circuit.

The first aspect of the present invention provides a current drive circuit of the invention includes a constant current source that generates a reference current, a current adjustment section, and a current output section. The current adjustment section generates a first current at a first node, the first current being the reference current multiplied by a first coefficient adjusted according to a target grayscale. The current output section includes a plurality of transistors connected to the first node in parallel, and a control circuit that controls the transistors to be ON or OFF. The current output section outputs a second current, which is the sum of the currents flowing through the transistors, and the second current is the first current multiplied by a second coefficient according to the target grayscale. A minimum value of the first coefficient is set in advance such that when the first coefficient is at the minimum value, the voltage at the first node is greater than or equal to a predetermined value set to be a value larger than the operation threshold voltage of the transistors in the current output section.

Therefore, in the current drive circuit, since the voltage at the first node always has a sufficiently high value, variation in the second current due to variation in the operation threshold voltage of the transistors in the current output section can be reduced.

The display device of the invention includes a display panel having current-driven light emitting elements disposed at the intersections of a plurality of row lines and a plurality of column lines, a scan section that sequentially scans the row lines, and a current drive section that supplies currents to the column lines. The current drive circuit of the invention is applied to the current drive section.

According to the current drive circuit of the invention, variation in output current is reduced. According to the display device of the invention, since variation in current flowing through display elements is reduced, variation in brightness of the display elements during light emission is reduced.

BRIEF DESCRIPTION OF THE DRAWINGS

FIG. 2 shows the relationship between selection signals and the value of an intermediate current Iint (the ratio of the intermediate current Iint to a reference current Iref) in the first embodiment;

FIG. 3 shows the contents of decoding performed in a decode circuit in the first embodiment;

DETAILED DESCRIPTION OF THE INVENTION

First Embodiment

A first embodiment of the current drive circuit of the invention will be described below.

—Configuration of Current Drive Circuit—

Figure 1:
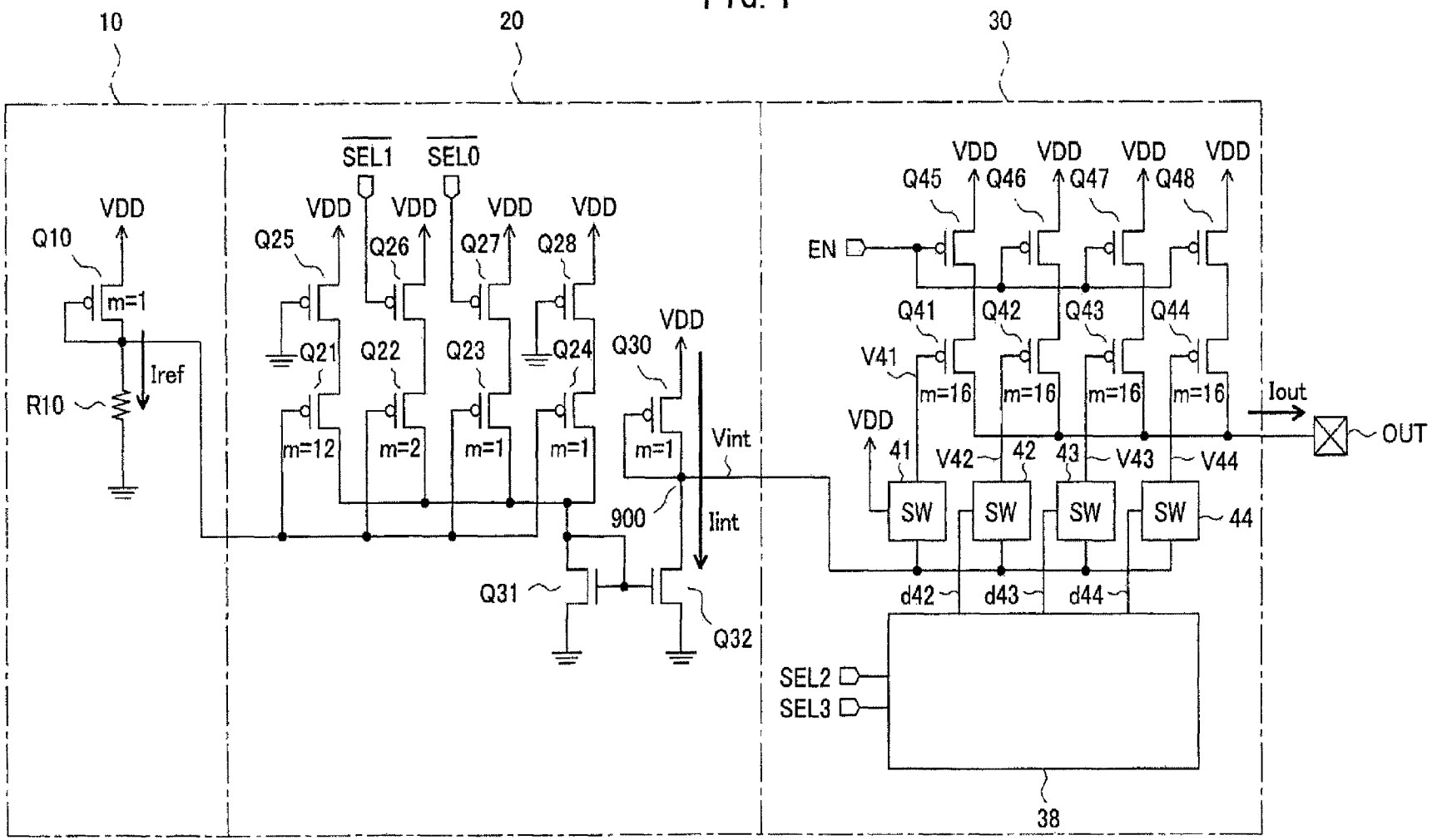
FIG. 1 is a circuit diagram of the current drive circuit of a first embodiment.

The configuration of a current drive circuit 1 of the present embodiment will first be described with reference to FIG. 1. FIG. 1 is a circuit diagram of the current drive circuit 1 of the embodiment.

The current drive circuit 1 generates 4-bit grayscale (16-grayscale) output currents. As shown in FIG. 1, the current drive circuit 1 includes a constant current source 10 that generates a reference current Iref, a current adjustment section 20 that generates an intermediate current Iint obtained by adjusting the reference current Iref according to a target grayscale, and a current output section 30 that generates an output current Iout. In the current drive circuit 1, the grayscale of the output current Iout is not generated only by the current adjustment section 20 but is generated by the current adjustment section 20 and the current output section 30.

It is assumed that the operation threshold voltages of PMOS transistors shown in FIG. 1 all have the same value. The value "m" (such as m=1 and m=12) labeled at each of the transistors is a value proportional to the size ratio of that transistor, that is, the W/L ratio (here, W is the gate width and L is the gate length). The value "m" determines the mirror ratio in a current mirror circuit.

In FIG. 1, the constant current source 10 includes a PMOS transistor Q10 and a resistor R10. In the PMOS transistor Q10, the gate and the drain form a short circuit, and the source is connected to a power supply potential VDD. One end of the resistor R10 is connected to the drain of the PMOS transistor Q10, and the other end is grounded. The resistor R10 allows adjustment of the magnitude of the reference current Iref. The configuration of the constant current source 10 is not limited to that shown in FIG. 1, but a differently configured circuit known to those skilled in the art may be applied.

The current adjustment section 20 includes a plurality of PMOS transistors Q21 to Q24, each of which and the PMOS transistor Q10 forming a current mirror circuit, a plurality of PMOS transistors Q25 to Q28 that control the PMOS transistors Q21 to Q24, respectively, to be ON or OFF, a current mirror circuit (NMOS transistors Q31 and Q32) that generates the intermediate current Iint adjusted according to a target grayscale, and a PMOS transistor Q30.

The gates of the PMOS transistors Q21 to Q24 are connected to the drain of the PMOS transistor Q10 in parallel, so that the PMOS transistors Q21 to Q24 and the PMOS transistor Q10 form current mirror circuits having mirror ratios of 12, 2, 1 and 1, respectively.

The drains of the PMOS transistors Q25 to Q28 are connected to the sources of the PMOS transistors Q21 to Q24, respectively, and the sources of the PMOS transistors Q25 to Q28 are connected to the power supply potential VDD. In the present embodiment, the PMOS transistors Q26 and Q27 are turned ON or OFF according to selection signals SEL1 and SEL0 (both low-active) provided to the gates of the PMOS transistors Q26 and Q27, respectively. As a result, the PMOS transistors Q22 and Q23 are turned ON or OFF. The gates of the PMOS transistors Q25 and Q28 are grounded, so that these transistors are always turned ON. In the present embodiment, the selection signals correspond to logical signals of the invention.

The gate and the drain of the NMOS transistor Q31 are connected to each other, and the sources of the NMOS transistors Q31 and Q32 are grounded. The NMOS transistors Q31 and Q32 thus form a current mirror circuit (the mirror ratio is 1:1). The drains of the PMOS transistors Q21 to Q24 are connected to the drain of the NMOS transistor Q31 in parallel. Therefore, the intermediate current Iint, which is the sum of the currents flowing through the PMOS transistors Q21 to Q24, flows into the NMOS transistor Q32.

The drain of the PMOS transistor Q30 is connected to the gate of the PMOS transistor Q30 and the drain of the NMOS transistor Q32. Now, let Vint be the drain voltage of the PMOS transistor Q30 (the voltage at a node 900 in FIG. 1).

FIG. 2 shows the relationship of the selection signals SEL0 and SEL1 with the value of the intermediate current Iint (the ratio of the intermediate current Iint to the reference current Iref). As shown in FIG. 2, the value of the intermediate current Iint is minimized when both the selection signals SEL0 and SEL1 are at the high level (H level). In this case, since both the PMOS transistors Q22 and Q23 are turned OFF, the intermediate current Iint is the sum of the currents flowing through PMOS transistor Q21 (the mirror ratio is 12) and the PMOS transistor Q24 (the mirror ratio is 1) (Iref×13). On the other hand, the value of the intermediate current Iint is maximized when both the selection signals SEL0 and SEL1 are at the low level (L level). In this case, the intermediate current Iint is the sum of the currents flowing through the PMOS transistors Q21 to Q24 (mirror ratios are 12, 2, 1 and 1, respectively) (Iref×16).

The current output section 30 includes a plurality of PMOS transistors Q41 to Q44, each of which and the PMOS transistor Q30 forming a current mirror circuit, a plurality of PMOS transistors Q45 to Q48 that control the PMOS transistors Q41 to Q44 to be ON or OFF according to an enable signal EN, respectively, switching circuits 41 to 44 that connect and disconnect the node 900 to and from the gates of the PMOS transistors Q41 to Q44 according to the target grayscale, and a decode circuit 38. The switching circuits 31-34 and the decode circuit 38 form the control circuit of the invention.

The gates of the PMOS transistors Q41 to Q44 are connected to the node 900 (the drain of the PMOS transistor Q30) in parallel via the switching circuits 41-44, respectively. Thus, when the corresponding switching circuit is turned ON, each of the PMOS transistors Q41 to Q44 configures the PMOS transistor Q30 and a current mirror circuit with a mirror ratio of 16.

The drains of the PMOS transistors Q45 to Q48 are connected to the sources of the PMOS transistors Q41 to Q44, respectively, and the sources of the PMOS transistors Q45 to Q48 are connected to the power supply potential VDD. In the present embodiment, the enable signal EN provided to the gates of the PMOS transistors Q45 to Q48 is always at the low level (L level), so that the PMOS transistors Q45 to Q48 are always turned ON.

The drains of the PMOS transistors Q41 to Q44 are connected to an output terminal OUT in parallel. An output current Iout, which is the sum of the currents flowing through the PMOS transistors Q41 to Q44, flows through the output terminal OUT. The magnitude of each of the currents is determined by the mirror ratio of the corresponding PMOS transistor to the PMOS transistor Q30.

FIG. 3 shows the contents of decoding performed in the decode circuit 38. The decode circuit 38 supplies decode signals d42 to d44 having logical levels shown in FIG. 3 to the switching circuits 42-44, respectively, according to selection signals SEL2 and SEL3. It is apparent to those skilled in the art that the contents of decoding shown in FIG. 3 are achieved by a combination of known gate circuits.

Figure 4:
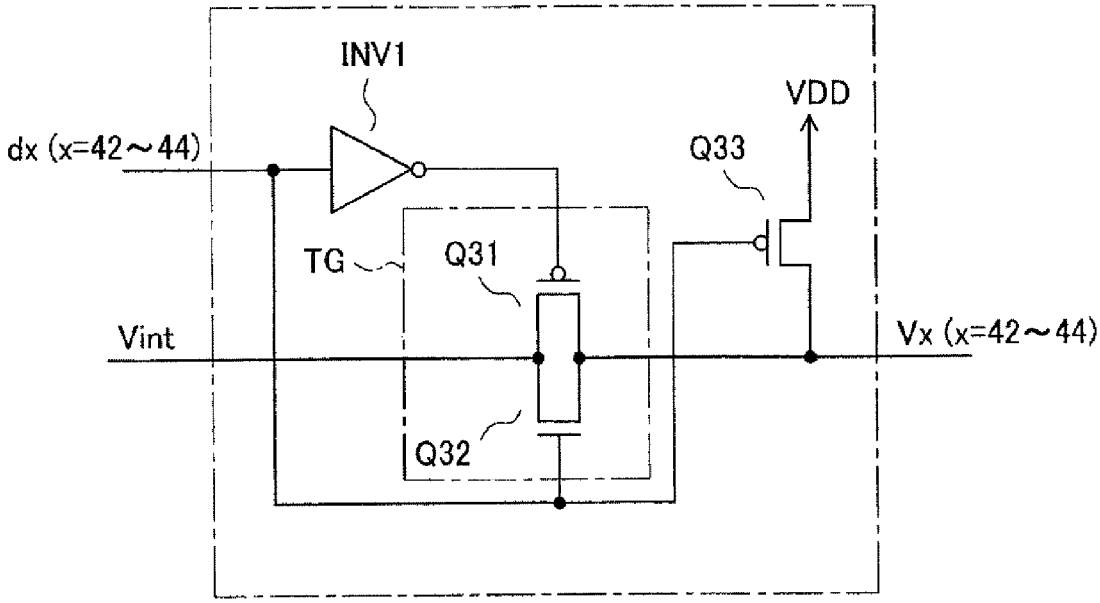
FIG. 4 is a circuit diagram showing an example of a switching circuit.

FIG. 4 is a circuit diagram showing an example of the switching circuit. The switching circuit includes an inverter INV1, a transmission gate TG (analog switch) formed of a PMOS transistor Q31 and an NMOS transistor Q32, and a PMOS transistor Q33. The voltage Vint at the node 900 is inputted to the transmission gate TG, and the output of the transmission gate TG is connected to the gate of the PMOS transistor corresponding to the switching circuit (either of Q41 to Q44).

In the switching circuit, the decode signal dx (x is either of 42 to 44) from the decode circuit 38 is provided to the gates of the NMOS transistors Q32 and the PMOS transistor Q33, and the inverted signal of the decode signal dx is provided to the gate of the PMOS transistor Q31. When the decode signal dx is at the L level, the transmission gate TG is closed and the PMOS transistor Q33 is turned ON, so that the output signal Vx (x is either of 42 to 44) of the switching circuit becomes the power supply potential VDD (H level). On the other hand, when the decode signal dx is at the H level, the transmission gate TG is open and the PMOS transistor Q33 is turned OFF, so that the output signal Vx (x is either of 42 to 44) of the switching circuit has the intermediate potential Vint (L level).

The output signals Vx are provided to the gates of the PMOS transistors Q42 to Q44, as shown in FIG. 1.

In the present embodiment, the power supply potential VDD (H level) is always provided as the decode signal to the switching circuit 41, and the output signal V41 of the switching circuit 41 is always at the L level (intermediate potential Vint).

In the configuration of the decode circuit 38 and the switching circuits 41-44, the value of the output current Iout becomes one of those shown in FIG. 3 according to the selection signals SEL2 and SEL3. That is, the current Iout is minimized when both the selection signals SEL2 and SEL3 are at the L level. In this case, only the output signal V41 of the switching circuit 41 is at the L level (intermediate potential Vint), so that the current Iout is equal to the current flowing through the PMOS transistor Q41 (the mirror ratio is 16) (Iint×16). On the other hand, the current Iout is maximized when both the selection signals SEL2 and SEL3 are at the H level. In this case, the output signals V41 to V44 of the switching circuits are all at the L level (intermediate potential Vint), so that the current Iout is the sum of the currents flowing through the PMOS transistors Q41 to Q44 (mirror ratios are 16) (Iint×64).

—Operation of Current Drive Circuit—

Referring again to FIG. 1, the operation of the current drive circuit 1 of the present embodiment will be described below.

In the current drive circuit 1, by providing the selection signals SEL0 to SEL3 from an external signal processing circuit (not shown) according to a target grayscale, the current Iout is outputted from the output terminal OUT.

For example, when the target grayscale is equal to a minimum grayscale, the external signal processing circuit (not shown) provides the selection signals, SEL0="H", SEL1="H", SEL2="L", and SEL3="L". In this case, in the current adjustment section 20, only the PMOS transistors Q25 and Q28 in the PMOS transistors Q25 to Q28 are turned ON, so that the intermediate current Iint becomes 13×Iref, as shown in FIG. 2. In the current output section 30, only the PMOS transistor Q41 in the PMOS transistors Q41 to Q44 is turned ON, so that the output current Iout becomes 16×Iint, as shown in FIG. 3. Therefore, when the target grayscale is equal to the minimum grayscale, the output current Iout becomes 13×16×Iref.

On the other hand, when the target grayscale is equal to a maximum grayscale, the external signal processing circuit (not shown) provides the selection signals, SEL0="L", SEL1="L", SEL2="H", and SEL3="H". In this case, in the current adjustment section 20, all the PMOS transistors Q25 to Q28 are turned ON, so that the intermediate current Iint becomes 16×Iref, as shown in FIG. 2. In the current output section 30, only the PMOS transistor Q41 is turned ON among the PMOS transistors Q41 to Q44, so that the output current Iout becomes 64×Iint, as shown in FIG. 3. Therefore, when the target grayscale is equal to the maximum grayscale, the output current Iout becomes 16×64×Iref.

In the current adjustment section 20, the potential Vint at the drain of the PMOS transistor Q30 (node 900) is proportional to the intermediate current Iint. In the current drive circuit 1 of the present embodiment, even when the target grayscale is equal to the minimum grayscale, the potential is sufficiently large (intermediate current Iint (=13×Iref)), so that variation in current flowing through the PMOS transistors Q41 to Q44 in the current output section 30 is very small. The following section explains how this happens.

It is generally known that the drain current $I_{DS}$ of a MOS transistor is approximated by the following equation (1). (For example, see "Semiconductor Devices" (Second Edition)—Fundamental Theory and Processing Technology—, (S. M. Sze, Sangyo Tosho Publishing Co., Ltd.), pp. 167-173)

$$I_{DS}=(1/2)k(W/L)(V_{GS}-Vt)^2 \quad (1)$$

where W is gate width, L is gate length, $V_{GS}$ is gate-source voltage, Vt is operation threshold voltage, and k is transconductance coefficient.

In the current drive circuit 1 of the present embodiment, drain currents $I_{DS}$ according to Equation (1) flow through the PMOS transistors Q41 to Q44 in the current output section 30. The smaller the gate-source voltage $V_{GS}$ of each of the PMOS transistors, that is, the smaller the potential Vint at the node 900, the greater the variation in the drain current $I_{DS}$. This is because, in Equation (1), the variation Δt in the operation threshold voltage Vt is substantially fixed independent of the value of the operation threshold voltage Vt itself, so that the smaller the gate-source voltage $V_{GS}$ is, the greater the impact of the variation Δt in the operation threshold voltage Vt on the drain current $I_{DS}$ becomes. In other words, the smaller the gate-source voltage $V_{GS}$ is, the greater the fluctuation of the drain current $I_{DS}$ due to the variation Δt in the operation threshold voltage Vt becomes.

From this point of view, the current drive circuit 1 of the present embodiment is designed to increase the gate potentials at the PMOS transistors Q41 to Q44 in the current output section 30, that is, the potential Vint at the drain (node 900) of the PMOS transistor Q30, such that the variation in the drain current $I_{DS}$ flowing through the PMOS transistors Q41 to Q44 is negligible. Specifically, when the target grayscale is equal to a minimum grayscale, by setting the intermediate current Iint to a relatively large value (13×Iref), the minimum value of the potential Vint becomes larger than a predetermined value (hereinafter referred to as a "first value"). In the current drive circuit 1 of the present embodiment, the minimum value of the intermediate current Iint is set to be 13 times the Iref only by way of example. The ratio of the intermediate current Iint to the reference current Iref when the intermediate current Iint is minimized is determined according to tolerance for variation in grayscale generated by the current drive circuit 1. For example, when the number of grayscales is large, the difference in output current Iout between successive grayscales is small, so that large variation in output current Iout is not tolerable. The first value therefore needs to be set to be a larger value than that set when the number of grayscales is small.

As described above, according to the current drive circuit of the present embodiment, the current adjustment section 20 and the current output section 30 generate a grayscale according to the target grayscale. That is, the current adjustment section 20 generates the intermediate current Iint (first current), which is the reference current Iref multiplied by a first coefficient (13 to 16 in this embodiment), and the current output section 30 generates the output current Iout (second current), which is the intermediate current Iint multiplied by a second coefficient (16 to 64 in this embodiment). The minimum value of the first coefficient (13 in this embodiment) is set such that the voltage at the node 900 (first node) when the first coefficient is at the minimum value is greater than or equal to the predetermined first value, which is set to be a larger value than the operation threshold voltage of the PMOS transistors (Q41 to Q44) in the current output section 30. Since the variation in current flowing through the PMOS transistors (Q41 to Q44) in the current output section 30 thus decreases, the variation in the output current Iout decreases.

Modified examples of the present embodiment will be described below.

FIRST MODIFIED EXAMPLE

Figure 5:
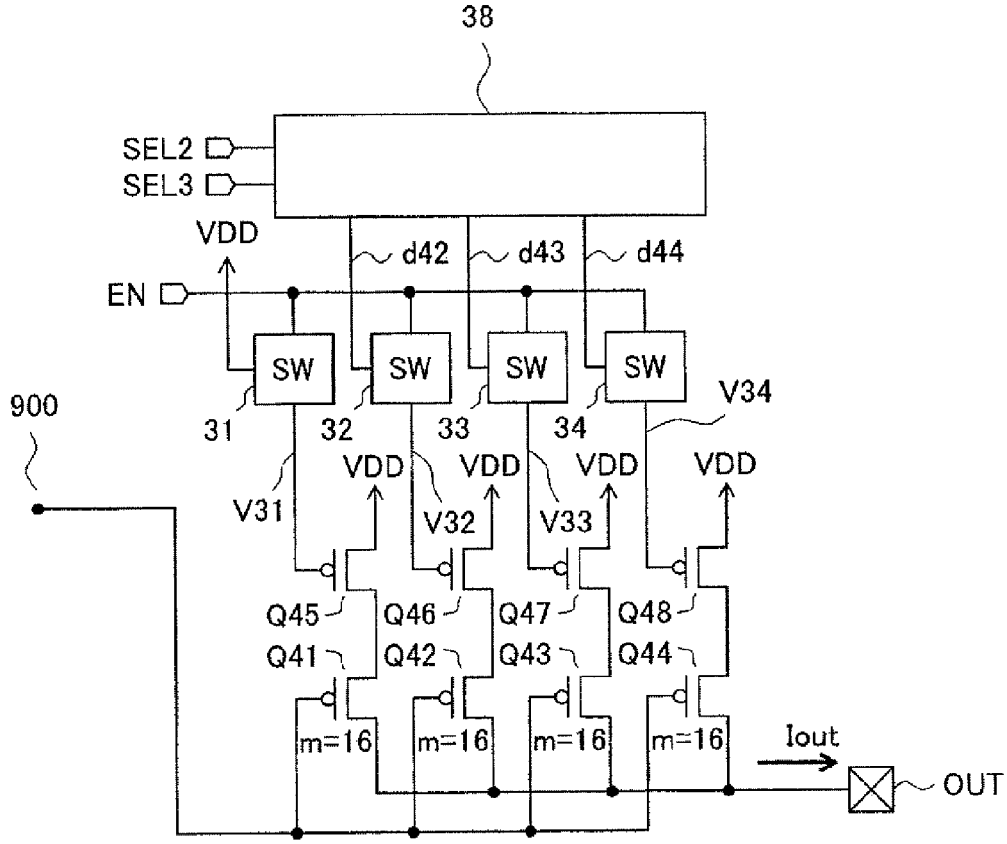
FIG. 5 shows a modified example (current output section) of the current drive circuit of the first embodiment.

In the current output section 30 shown in FIG. 1, although the decode circuit 38 and the switching circuits 41 to 44 control the PMOS transistors Q41 to Q44 to be ON or OFF, a similar effect is obtained by controlling the PMOS transistors Q45 to Q48, which are connected to the PMOS transistors Q41 to Q44 in series, to be ON or OFF. FIG. 5 shows a current output section configured such that ON or OFF of the PMOS transistors Q45 to Q48 are thus controlled.

In the current output section shown in FIG. 5, the decode circuit 38 generates the decode signals d42 to d44 according to the selection signals SEL2 and SEL3 and supplies them to switching circuits 32 to 34, respectively. Output signals V31 to V34 of the switching circuits 31 to 34 are provided to the gates of the PMOS transistors Q45 to Q48, respectively. The configuration illustrated in FIG. 4 may be applied to each of the switching circuits 31 to 34. In FIG. 5, the enable signal EN has a potential that turns the PMOS transistors Q45 to Q48 ON (potential at the L level).

In FIG. 5, the current Iout is minimized when both the selection signals SEL2 and SEL3 are at the L level. In this case, since only the output signal V31 of the switching circuit 31 is at the L level (enable signal EN), the current Iout is equal to the current that flows through the PMOS transistor Q41 (the mirror ratio is 16) (Iint×16). On the other hand, the current Iout is maximized when both the selection signals SEL2 and SEL3 are at the H level. In this case, since all the output signals V31 to V34 of the switching circuits are at the L level (enable signal EN), the current Iout is the sum of the currents flowing through the PMOS transistors Q41 to Q44 (mirror ratios are 16) (Iint×64).

SECOND MODIFIED EXAMPLE

A second modified example will be described with reference to FIG. 6.

In the embodiment shown in FIG. 1, since the voltage at the node 900 is greater than or equal to the first value, the output current Iout produced when the target grayscale is equal to the minimum grayscale (=13×16×Iref) is large. In the second modified example of the present embodiment, the current drive circuit is configured by changing the configuration of the current output section such that the output current Iout for a small grayscale is reduced while the voltage at the node 900 is greater than or equal to the first value.

Figure 6:
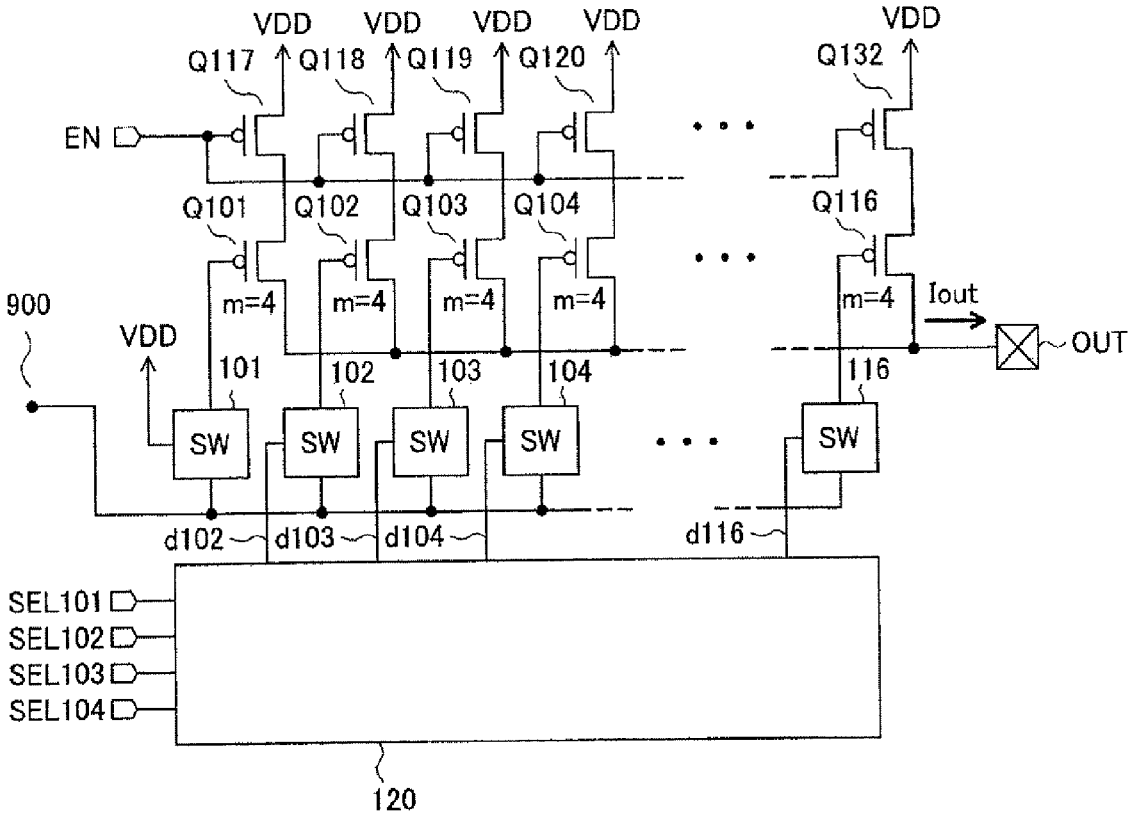
FIG. 6 shows another modified example (current output section) of the current drive circuit of the first embodiment.

FIG. 6 is a circuit diagram of a current output section 100 in the current drive circuit according to the modified example of the present embodiment. Although in the current output section 30 described above, four PMOS transistors, each having a mirror ratio of 16, are connected in parallel, in the current output section 100, 16 PMOS transistors, each having a mirror ratio of 4, are connected in parallel.

The current output section 100 includes 16 PMOS transistors Q101 to Q116, each of which and the PMOS transistor Q30 form a current mirror circuit, 16 PMOS transistors Q117 to Q132 that control the PMOS transistors Q101 to Q116, respectively, to be ON or OFF, according to the enable signal EN, switching circuits 101 to 116 that connect and disconnect the node 900 to and from the gates of the PMOS transistors Q101 to Q116 according to a target grayscale, and a decode circuit 120.

The gates of the PMOS transistors Q101 to Q116 are connected to the node 900 (the drain of the PMOS transistor Q30) in parallel via the switching circuits 101 to 116, respectively. Thus, each of the PMOS transistors Q101 to Q116, when the corresponding switching circuit is turned ON, and the PMOS transistor Q30 form a current mirror circuit with a mirror ratio of 4.

The drains of the PMOS transistors Q117 to Q132 are connected to the sources of the PMOS transistors Q101 to Q116, respectively, and the sources of the PMOS transistors Q117 to Q132 are connected to the power supply potential VDD. As in the current output section 30, the enable signal EN provided to the gates of the PMOS transistors Q117 to Q132 is always at the L level, so that the PMOS transistors Q117 to Q132 are always turned ON.

The drains of the PMOS transistors Q101 to Q116 are connected to the output terminal OUT in parallel. The output current Iout, which is the sum of the currents flowing through the PMOS transistors Q101 to Q116, flows through the output terminal OUT. The magnitude of each of the currents is determined by the mirror ratio of the corresponding PMOS transistor to the PMOS transistor Q30.

According to the target grayscale, the decode circuit 120 generates 16 different combinations of decode signals d102 to d116 using the logical levels of selection signals SEL10, SEL102, SEL103, and SEL104, and supplies them to the switching circuits 101 to 116. Therefore, one or more PMOS transistors selected from the PMOS transistors Q101 to Q116 according to the target grayscale are turned ON.

In this variation of the current drive circuit, for example, when the target grayscale is equal to a minimum grayscale, an external signal processing circuit (not shown) provides the selection signals, SEL0="H", SEL1="H", and SEL101 to SEL104="L". In this case, in the current adjustment section 20, the intermediate current Iint becomes 13×Iref, as shown in FIG. 2. In the current output section 100, only the PMOS transistor Q101 in the PMOS transistors Q101 to Q116 is turned ON, so that the output current Iout becomes 4×Iint. Therefore, when the target grayscale is equal to the minimum grayscale, the output current Iout becomes 13×4×Iref. Thus, according to the second variation, the output current Iout for a small grayscale can be reduced while the voltage at the node 900 is greater than or equal to the first value as in the embodiment described above.

In the current output section 100 described above, although the 16 PMOS transistors, each having a fixed mirror ratio of 4, are connected in parallel, in general, $2^N$ rows of PMOS transistors may be provided in the current output section when there are N (N is an integer) selection signals. The greater the number N is, the smaller the mirror ratio of each of the PMOS transistors in the current output section becomes. For example, while the variation shown in FIG. 6 is the case where N is 4, when N is 5, the mirror ratio of each of the PMOS transistors is set to be 2.

Second Embodiment

A second embodiment of the current drive circuit of the invention will be described below.

The current drive circuit of the present embodiment is the same as that in the first embodiment except the current output section, which will only be described below. Unlike the current output section 30 described above, the current output section in the current drive circuit of the second embodiment is characterized in that the number of PMOS transistors is reduced by setting to be different mirror ratios for a plurality of PMOS transistors.

—Configuration of Current Drive Circuit—

Figure 7:
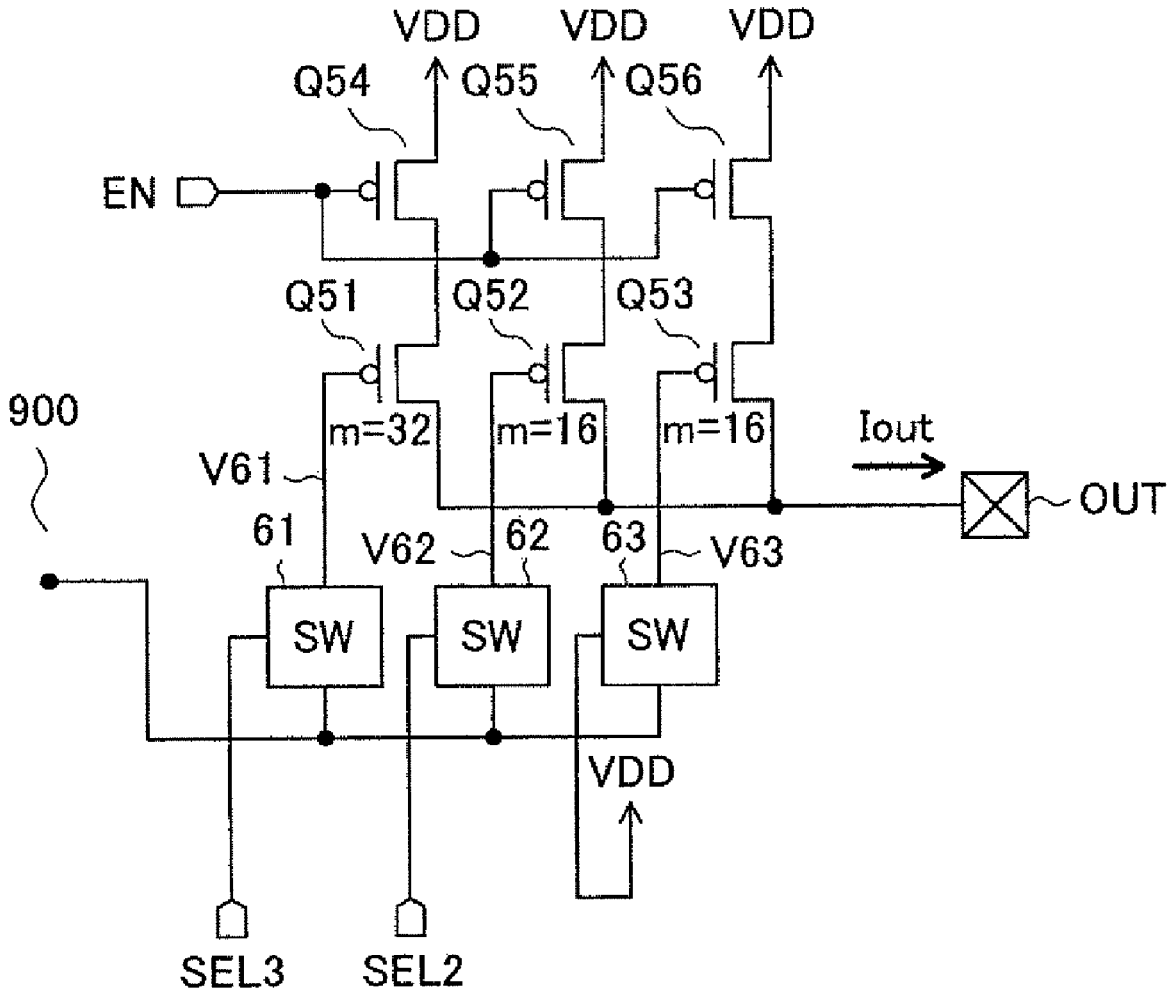
FIG. 7 is a circuit diagram of a current output section in the current drive circuit of a second embodiment.

The configuration of a current output section 50 of the present embodiment will first be described with reference to FIG. 7. FIG. 7 is a circuit diagram of the current output section 50 in the current drive circuit of the present embodiment.

The current output section 50 includes a plurality of PMOS transistors Q51 to Q53, each of which and the PMOS transistor Q30 form a current mirror circuit, a plurality of PMOS transistors Q54 to Q56 that control the PMOS transistors Q51 to Q53, respectively, to be ON or OFF, according to the enable signal EN, and switching circuits 61 to 63 that connect and disconnect the node 900 to and from the gates of the PMOS transistors Q51 to Q53 according to a target grayscale. The configuration illustrated in FIG. 4 may be applied to each of the switching circuits. The switching circuits 61 to 63 form the control circuit of the invention.

The gates of the PMOS transistors Q51 to Q53 are connected to the node 900 (the drain of the PMOS transistor Q30) in parallel via the switching circuits 61 to 63, respectively. Thus, each of the PMOS transistors Q51 to Q53, when the corresponding switching circuit is turned ON, and the PMOS transistor Q30 form a current mirror circuit, the mirror ratios of the current mirror circuits being 32, 16 and 16, respectively.

The drains of the PMOS transistors Q54 to Q56 are connected to the sources of the PMOS transistors Q51 to Q53, respectively, and the sources of the PMOS transistors Q54 to Q56 are connected to the power supply potential VDD. In the present embodiment, the enable signal EN provided to the gates of the PMOS transistors Q54 to Q56 is always at the low level (L level), so that the PMOS transistors Q54 to Q56 are always turned ON.

The drains of the PMOS transistors Q51 to Q53 are connected to the output terminal OUT in parallel. The output current Iout, which is the sum of the currents flowing through the PMOS transistors Q51 to Q53, flows through the output terminal OUT. The magnitude of each of the currents is determined by the mirror ratio of the corresponding PMOS transistor to the PMOS transistor Q30.

—Operation of Current Drive Circuit—

The operation of the current output section 50 in the current drive circuit of the present embodiment will be described below with reference to FIG. 7. In this current drive circuit, by providing selection signals SEL0 to SEL3 from an external signal processing circuit (not shown) according to the target grayscale, the current Iout is outputted from the output terminal OUT.

When the target grayscale is equal to a minimum grayscale, the external signal processing circuit (not shown) provides the selection signals, SEL0="H", SEL1="H", SEL2="L", and SEL3="L". In this case, in the current output section 50, output signals V61 to V63 of the switching circuits 61 to 63 are at the H level (power supply potential VDD), the H level (power supply potential VDD), and the L level (intermediate potential Vint), respectively. Only the PMOS transistor Q53 in the PMOS transistors Q51 to Q53 is thus turned ON, so that the output current Iout becomes 16×Iint.

On the other hand, when the target grayscale is equal to a maximum grayscale, the external signal processing circuit (not shown) provides the selection signals, SEL0="L", SEL1="L", SEL2="H", and SEL3="H". In this case, in the current output section 50, all the output signals V61 to V63 of the switching circuits 61 to 63 are at the L level (intermediate potential Vint). All the PMOS transistor Q51 to Q53 are thus turned ON, so that the output current Iout becomes 64×Iint.

In the current drive circuit of the present embodiment, as in the first embodiment, the minimum value of the voltage at the node 900 (first node) is greater than or equal to a predetermined first value, which is set to be a value larger than the operation threshold voltage of the PMOS transistors (Q51 to Q53) in the current output section 50. Therefore, since variation in current flowing through the PMOS transistors (Q51 to Q53) in the current output section 50 decreases, variation in the output current Iout decreases. In addition, since the number of PMOS transistors in the current output section 50 is smaller than that in the current output section 30 in the first embodiment, the circuit scale of the current drive circuit can be reduced.

In general, by setting to be different size ratios for at least two transistors in a plurality of rows in the current output section, the number of rows of PMOS transistors provided in the current output section may be smaller than $2^N$ when there are N (N is an integer) selection signals.

Third Embodiment

Figure 8:
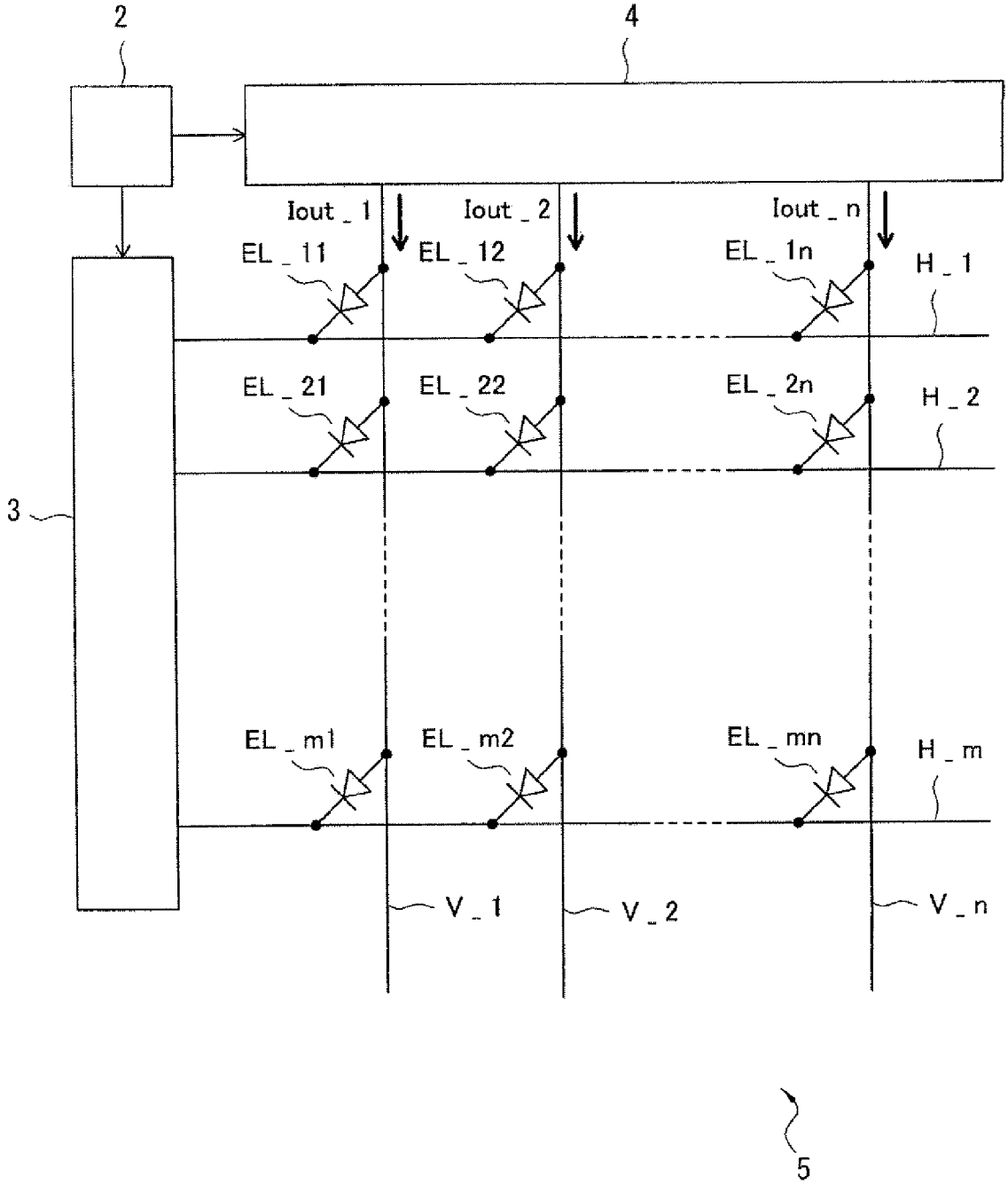
FIG. 8 shows the circuit configuration of an embodiment (third embodiment) of the display device of the invention.

An embodiment of the display device of the invention will be described below with reference to FIG. 8. FIG. 8 shows the circuit configuration of the display device of the present embodiment.

The display device of the present embodiment includes a signal processing circuit 2, a cathode driver 3 (scan section), an anode driver 4 (current drive section), and a display panel 5. In the display panel 5, m×n EL (electroluminescence) elements E_11 to E_mn arranged in a matrix are connected to respective m cathode lines (row lines) and n anode lines (column lines) at the positions where these cathode lines and anode lines intersect.

The cathode driver 3 has a plurality of switching elements (not shown) connected to the cathode lines H_1 to H_m. The switching elements are operated according to scan control signals from the signal processing circuit 2 and connect the cathode lines H_1 to H_m to either a power supply potential or a ground potential. By connecting a cathode line to be scanned to the power supply potential, a reverse bias voltage is provided to the EL element connected to that cathode line.

The anode driver 4 includes current drive circuits connected to the anode lines V_1 to V_n. The current drive circuits output output currents Iout_1 to Iout_n to the anode lines V_1 to V_n according to target grayscale signals (for example, the selection signals SEL0 to SEL3 described above) determined by the signal processing circuit 2. The current drive circuit of the first or second embodiment is applied to each of the current drive circuits. For example, to drive the EL element E_21 for light emission, the corresponding current drive circuit in the anode driver 4 outputs the output current Iout_1 having a desired grayscale to the anode line V_1 when the cathode line H_2 is scanned, that is, when the cathode line H_2 is grounded. In this way, a forward bias is provided to the EL element E_21, which then emits light at the desired grayscale.

In the anode driver 4 in the display device of the present embodiment, since an output current of the current drive circuit of the first or second embodiment is provided to each anode line, a highly accurate output current with small variation is supplied to each EL element, thus reducing variation in brightness of the EL element.

While the embodiments of the invention have been described in detail above, specific configurations and systems are not limited thereto. Design changes and adaptation to other systems are included in the scope of the invention as long as they do not depart from the spirit of the invention.

What is claimed is:

1. A current drive circuit comprising:

a constant current source that generates a reference current;

a current adjustment section that generates a first current at a first node, the first current being the reference current multiplied by a first coefficient adjusted according to a target grayscale; and a current output section including a plurality of transistors connected to the first node in parallel, and a control circuit that controls the transistors to be on or off, the current output section outputting a second current, which is the sum of the currents flowing through the transistors, the second current being the first current multiplied by a second coefficient according to the target grayscale, wherein a minimum value of the first coefficient is set in advance such that when the first coefficient is at the minimum value, the voltage at the first node is greater than or equal to a predetermined value set to be a value larger than the operation threshold voltage of the transistors in the current output section.

2. The current drive circuit according to claim 1, wherein

N logical signals are provided to the control circuit, wherein N is an integer;

the size ratios of the plurality of transistors are equal to each other, the number of the plurality of transistors being $2^N$, and the control circuit controls the plurality of transistors to be on or off based on the N logical signals.

3. The current drive circuit according to claim 1, wherein N logical signals are provided to the control circuit, wherein N is an integer;

the size ratios of at least two of the plurality of transistors are set to be different from each other, the number of the plurality of transistors being smaller than $2^N$, and the control circuit controls the plurality of transistors to be on or off based on the N logical signals.

4. A display device comprising:

a display panel having current-driven light emitting elements disposed at the intersections of a plurality of row lines and a plurality of column lines;

a scan section that sequentially scans the row lines; and a current drive section that supplies currents to the column lines, wherein the current drive section includes:

a constant current source that generates a reference current;

a current adjustment section that generates a first current at a first node, the first current being the reference current multiplied by a first coefficient adjusted according to a target grayscale; and a current output section including a plurality of transistors connected to the first node in parallel, and a control circuit that controls the transistors to be on or off, the current output section outputting a second current, which is the sum of the currents flowing through the transistors, the second current being the first current multiplied by a second coefficient according to the target grayscale, wherein a minimum value of the first coefficient is set in advance such that when the first coefficient is at the minimum value, the voltage at the first node is greater than or equal to a predetermined value set to be a value larger than the operation threshold voltage of the transistors in the current output section.

* * * * *